US010590541B2

(12) United States Patent
Lifschitz Arribio et al.

(10) Patent No.: US 10,590,541 B2
(45) Date of Patent: Mar. 17, 2020

(54) ELECTROLESS COPPER PLATING COMPOSITIONS AND METHODS FOR ELECTROLESS PLATING COPPER ON SUBSTRATES

(71) Applicant: Rohm and Haas Electronic Materials LLC, Marlborough, MA (US)

(72) Inventors: Alejo M. Lifschitz Arribio, Wallham, MA (US); Donald E. Cleary, Littleton, MA (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 96 days.

(21) Appl. No.: 16/009,410

(22) Filed: Jun. 15, 2018

(65) Prior Publication Data

US 2019/0382899 A1 Dec. 19, 2019

(51) Int. Cl.

| | |
|---|---|
| ***C23C 18/40*** | (2006.01) |
| ***C23C 18/16*** | (2006.01) |
| ***C23C 18/18*** | (2006.01) |
| ***C23C 18/30*** | (2006.01) |

(52) U.S. Cl.
CPC ..... *C23C 18/40* (2013.01)

(58) Field of Classification Search
None
See application file for complete search history.

(56) References Cited

U.S. PATENT DOCUMENTS 3,919,056 A * 11/1975 Habulak ..... C25D 3/22 205/310
5,242,713 A * 9/1993 Viehbeck ..... C23C 18/28 427/304
9,611,550 B2 * 4/2017 Chow ..... C23C 18/40
10,294,569 B2 * 5/2019 Lifschitz Arribio ..... C23C 18/405
2004/0231995 A1 * 11/2004 Murao ..... C25D 3/38 205/125
2008/0038450 A1 * 2/2008 Poole ..... C23C 18/40 427/97.9
2014/0054788 A1 * 2/2014 Majima ..... B82Y 10/00 257/773
2014/0178572 A1 * 6/2014 Chow ..... C23C 18/40 427/97.9
2016/0020311 A1 * 1/2016 Majima ..... H01L 29/7613 257/9
2016/0076160 A1 * 3/2016 Whitten ..... C25D 3/38 205/297
2016/0312365 A1 * 10/2016 Cordonier ..... B32B 15/01
2019/0106793 A1 * 4/2019 Lifschitz Arribio ..... C23C 18/405
2019/0382900 A1 * 12/2019 Lifschitz Arribio ..... C23C 18/405
2019/0382901 A1 * 12/2019 Lifschitz Arribio ..... C23C 18/405

FOREIGN PATENT DOCUMENTS

FR 2359215 A1 * 2/1978
GB 2032462 A * 5/1980
JP 2006/009079 A * 1/2006
JP WO 2016/035645 A * 6/2017

OTHER PUBLICATIONS

EPO Written Opinion for EP Application No. 19179161, dated Oct. 9, 2019; 2 pages.*
English translation of JP 2006/009079, Jan. 2006; 24 pages.*
English translation of FR 2359215, Feb. 1978; 11 pages.*
English translation of JPWO 2016/035645, Jun. 2017; 39 pages.*
Search report for corresponding Europe Application No. 19 17 9161 dated Sep. 26, 2019.

* cited by examiner

*Primary Examiner* — Helene Klemanski
(74) *Attorney, Agent, or Firm* — John J. Piskorski

(57) ABSTRACT

Stable electroless copper plating baths include di-cation viologen compounds to improve rate of copper deposition on substrates. The copper from the electroless plating baths can be plated at low temperatures and at high plating rates.

10 Claims, 6 Drawing Sheets

ELECTROLESS COPPER PLATING COMPOSITIONS AND METHODS FOR ELECTROLESS PLATING COPPER ON SUBSTRATES

FIELD OF THE INVENTION

The present invention is directed to electroless copper plating compositions and methods for electroless plating copper on substrates, wherein electroless copper plating has a high electroless copper plating rate at low temperatures and the electroless copper plating composition has good stability. More specifically, the present invention is directed to electroless copper plating compositions and methods for electroless plating copper on substrates, wherein electroless copper plating has a high electroless copper plating rate at low temperatures and the electroless copper plating composition has good stability, and, wherein the electroless copper plating compositions include di-cation viologen compounds.

BACKGROUND OF THE INVENTION

Electroless copper plating baths are in widespread use in metallization industries for depositing copper on various types of substrates. In the manufacture of printed circuit boards, for example, the electroless copper baths are used to deposit copper on walls of through-holes and circuit paths as a base for subsequent electrolytic copper plating. Electroless copper plating also is used in the decorative plastics industry for deposition of copper on non-conductive surfaces as a base for further plating of copper, nickel, gold, silver and other metals, as required. Electroless copper baths which are in commercial use today contain water soluble divalent copper compounds, chelating agents or complexing agents, for example, Rochelle salts and sodium salts of ethylenediamine tetraacetic acid, for the divalent copper ions, reducing agents, for example, formaldehyde, and formaldehyde precursors or derivatives, and various addition agents to make the bath more stable, adjust the plating rate and brighten the copper deposit.

It should be understood, however, that every component in the electroless copper bath has an effect on plating potential, and therefore, must be regulated in concentration to maintain the most desirable plating potential for particular ingredients and conditions of operation. Other factors which affect internal plating voltage, deposition quality and rate include temperature, degree of agitation, type and concentration of basic ingredients mentioned above.

In electroless copper plating baths, the components are continuously consumed such that the baths are in a constant state of change, thus consumed components must be periodically replenished. Control of the baths to maintain high plating rates with substantially uniform copper deposits over long periods of time is exceedingly difficult. Consumption and replenishment of bath components over several metal turnovers (MTO) can also contribute to bath instability, for example, through the buildup of side products. Therefore, such baths, and particularly those having a high plating potential, i.e. highly active baths, tend to become unstable and to spontaneously decompose with use. Such electroless copper bath instability can result in non-uniform or discontinuous copper plating along a surface. For example, in the manufacture of printed circuit boards, it is important to plate electroless copper on the walls of through-holes such that the copper deposit on the walls is substantially continuous and uniform with minimal, preferably, no break or gaps in the copper deposit. Such discontinuity of the copper deposit can ultimately lead to mal-functioning of any electrical device in which the defective printed circuit board is included.

Another issue associated with electroless copper plating is the stability of the electroless copper plating bath in the presence of high catalyst metal leaching. Electroless copper plating utilizes various metal containing catalysts, such as colloidal palladium-tin catalysts and ionic metal catalysts, to initiate the electroless copper plating process. Such metal containing catalysts can be sensitive to the plating conditions such as pH of the electroless copper bath, electroless plating temperature, components and concentrations of the components in the electroless copper baths, wherein such parameters can result in at least metal leaching from the catalyst, thus further destabilizing the electroless copper bath.

To address the foregoing stability issues, various chemical compounds categorized under the label "stabilizers" have been introduced to electroless copper plating baths. Examples of stabilizers which have been used in electroless copper plating baths are sulfur containing compounds, such as disulfides and thiols. However, many stabilizers lower electroless copper plating rates, and, also, at high concentrations can be catalyst poisons, thus reducing plating rates or inhibiting plating and compromising the performance of the plating bath. Low plating rates are detrimental to electroless copper plating performance. Electroless copper plating rate is also temperature dependent, thus when high stabilizer concentrations lower the rate, increasing the plating temperature can increase the rate. However, increasing the operating temperatures can decrease the stability of the electroless copper bath by increasing the buildup of byproducts as well as reducing bath additives by side reactions, thus negating some of the effects of increasing the stabilizer concentration. As a result, in most cases the amount of stabilizer used must be a careful compromise between maintaining a high plating rate and achieving an electroless bath that is stable over a long period of time. Rate acceleration in electroless copper plating is a key strategy for lowering working temperatures, lowering internal stress of copper deposits such as on flexible substrates and decreasing overall running costs of metallization.

Examples of flexible substrates are polyimides and polyimide matrix composites. Such polyimides and polyimide matrix composites are used in electronics, automotive, aerospace and other applications. Under conditions in which polyimides have absorbed water, either by exposure to high humidity or by direct immersion the electroless copper deposit on the polyimides may blister. Blister formation seriously compromises smooth and uniform copper layer coverage on polyimides. To avoid blistering, plating on the surfaces of polyimides requires the deposition of a low stress electroless copper deposit. Accordingly, stress reducers are typically included in such electroless copper baths. One commonly used stress reducer is 2,2'-bipyridyl which can reduce blistering on polyimide substrates. However, 2,2'-dibipyridyl is also a plating rate suppressor. To compensate for the rate suppressing effect of the 2,2'-dipyridyl, the temperature of the plating bath must be increased, thus increasing the probability of undesired blister formation resulting in irregular, dull and rough copper deposits and negating the purpose of including stress reducing additives such as 2,2'-dipyridyl in the electroless plating bath.

Therefore, there is a need for an additive for electroless copper plating baths which enables a high rate of electroless copper plating at low temperatures to provide bright, smooth and uniform copper deposits on substrates and prevents blistering of polyimides.

SUMMARY OF THE INVENTION

The present invention is directed to an electroless copper plating composition including one or more sources of copper ions, one or more di-cation viologen compounds having a formula:

(I)

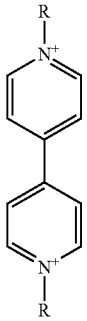

[anion(s)], wherein R is selected from the group consisting of linear or branched ($C_1$-$C_{10}$)alkyl, linear or branched hydroxy($C_1$-$C_{10}$)alkyl, linear or branched alkoxy($C_1$-$C_{10}$)alkyl, linear or branched carboxy($C_1$-$C_{10}$)alkyl, benzyl, amino and cyano, a counter anion(s) to neutralize the one or more di-cation viologen compounds, one or more complexing agents, one or more reducing agents, and, optionally, one or more pH adjusting agents, wherein a pH of the electroless copper plating composition is greater than 7.

The present invention is also directed to a method of electroless copper plating including:

a) providing a substrate comprising a dielectric;
b) applying a catalyst to the substrate comprising the dielectric;
c) applying an electroless copper plating composition to the substrate comprising the dielectric, wherein the electroless copper plating composition comprises one or more sources of copper ions, one or more di-cation viologen compounds having a formula:

(I)

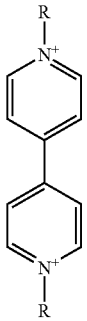

[anion(s)], wherein R is selected from the group consisting of linear or branched ($C_1$-$C_{10}$)alkyl, linear or branched hydroxy ($C_1$-$C_{10}$)alkyl, linear or branched alkoxy($C_1$-$C_{10}$)alkyl, linear or branched carboxy($C_1$-$C_{10}$)alkyl, benzyl, amino and cyano, a counter anion(s) to neutralize the one or more di-cation viologen compounds, one or more complexing agents, one or more reducing agents, and, optionally, one or more pH adjusting agents, wherein a pH of the electroless copper plating composition is greater than 7; and d) electroless plating copper on the substrate comprising the dielectric with the electroless copper plating composition.

The di-cation viologen compounds enable increased electroless copper plating rates at low plating temperatures of less than or equal to 40° C. The electroless copper plating compositions and methods of the present invention further enable good through-hole wall coverage, even over high metal turnover (MTO), and low plating temperatures. Low plating temperatures reduce consumption of electroless copper plating composition additives, which occur by undesired side reactions or by decomposition at high temperatures, thus providing a more stable electroless copper plating composition, and lowers the cost of operating the electroless copper plating process.

The electroless copper plating compositions of the present invention are stable over wide concentration ranges of the di-cation viologen compounds. A broad operating window for the di-cation viologen compound concentration means that the di-cation viologen concentration does not need to be carefully monitored such that the performance of the electroless copper plating composition does not substantially change regardless of how the composition components are being replenished and consumed.

In addition, the electroless copper plating compositions and methods of the present invention enable good electroless copper plating at low temperatures of polyimide substrates and at the same time inhibit undesired blistering of the polyimide.

DETAILED DESCRIPTION OF THE INVENTION

Figure 1:
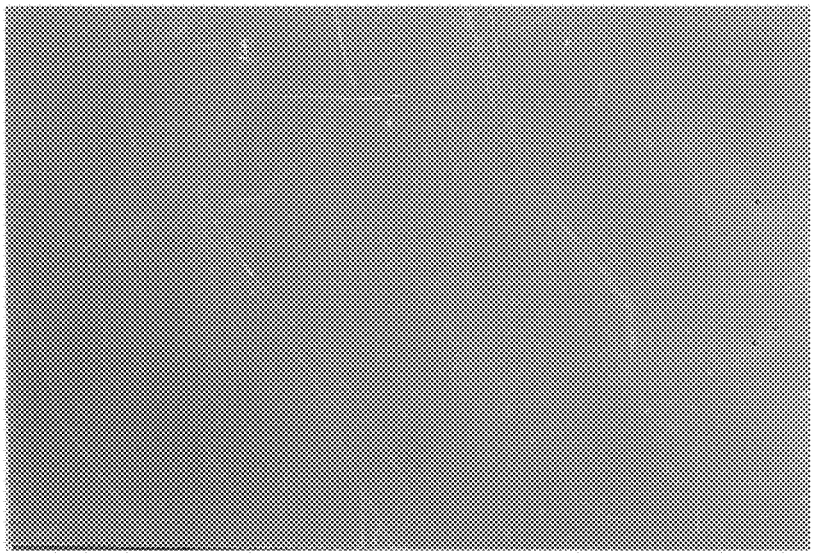
FIG. 1 is a photograph of an FR/4 glass-epoxy panel plated with an electroless copper bath of the present invention containing ethyl viologen dibromide taken with a digital 4 megapixel camera without magnification.

As used throughout this specification, the abbreviations given below have the following meanings, unless the context clearly indicates otherwise: g=gram; mg=milligram; mL=milliliter; L=liter; cm=centimeter; m=meter; mm=millimeter; μm=micron; ppm=parts per million=mg/L; hr.=hour; min.=minute; MTO=metal turnover; mTorr=milliTorr; W=Watts; PI=polyimide; ° C.=degrees Centigrade; g/L=grams per liter; DI=deionized; Pd=palladium; Pd(II)=palladium ions with a +2 oxidation state; Pd°=palladium reduced to its metal state vs. its ionic state; C=the element carbon; wt %=percent by weight; $T_g$=glass transition temperature; and e.g.=for example.

All amounts are percent by weight, unless otherwise noted. All numerical ranges are inclusive and combinable in any order except where it is logical that such numerical ranges are constrained to add up to 100%.

The terms "plating" and "deposition" are used interchangeably throughout this specification. The terms "composition" and "bath" are used interchangeably throughout this specification. The term "alkyl", unless otherwise described in the specification as having substituent groups, means an organic chemical group composed only of carbon and hydrogen and having a general formula: $C_nH_{2n+1}$. The term "metal turnover (MTO)" means the total amount of replacement metal added is equal to the total amount of metal originally in the plating composition. MTO value for a particular electroless copper plating composition=total copper deposited in grams divided by the copper content in the plating composition in grams. The term "average" is equivalent to the mean value of a sample. All amounts are percent by weight, unless otherwise noted. All numerical ranges are inclusive and combinable in any order except where it is logical that such numerical ranges are constrained to add up to 100%.

The electroless copper plating compositions of the present invention include one or more sources of copper ions, including the counter anions; one or more viologen compounds having a formula:

(I)

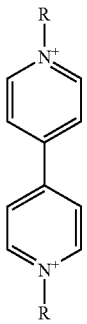

[anion(s)], wherein R is selected from the group consisting of linear or branched ($C_1$-$C_{10}$)alkyl, linear or branched hydroxy($C_1$-$C_{10}$)alkyl, linear or branched alkoxy($C_1$-$C_{10}$)alkyl, linear or branched carboxy($C_1$-$C_{10}$)alkyl, benzyl, amino and cyano, a counter anion(s) to neutralize the one or more di-cation viologen compounds, one or more complexing agents, one or more reducing agents, water, and, optionally, one or more pH adjusting agents, wherein a pH of the electroless copper plating composition is greater than 7.

Preferably, R is selected from the group consisting of linear or branched ($C_1$-$C_8$)alkyl, linear or branched hydroxy ($C_1$-$C_4$)alkyl, linear or branched alkoxy($C_1$-$C_4$)alky, linear or branched carboxy($C_1$-$C_4$)alkyl, benzyl and amino, more preferably, R is selected from the group consisting of linear or branched ($C_1$-$C_4$)alkyl, hydroxy($C_1$-$C_3$)alkyl, alkoxy($C_1$-$C_2$)alkyl, carboxy($C_1$-$C_2$)alkyl and benzyl, even more preferably, R is selected from the group consisting of linear or branched ($C_1$-$C_3$)alky, benzyl and hydroxy($C_1$-$C_2$)alkyl, most preferably, R is selected from the group consisting of ($C_1$-$C_2$)alkyl, wherein $C_1$-alkyl is methyl and $C_2$-alkyl is ethyl.

Preferably, the anion is chosen from sulfate, carbonate, acetate, hydroxide, tosylate, triflate, nitrate, halogen, wherein the halogen is selected from the group consisting of chloride, bromide, fluoride and iodide. More preferably, the anion is a halogen selected from the group consisting of chloride and bromide, most preferably, the anion is the halogen bromide.

A most preferred di-cation viologen is ethyl viologen dibromide having a formula:

(II)

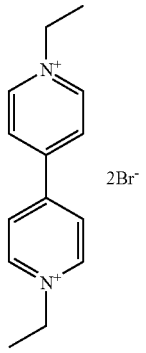

An example of another preferred di-cation viologen compound of the present invention is benzyl viologen dichloride having a formula:

(III)

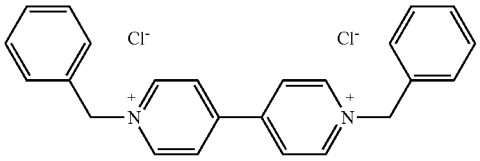

The di-cation viologen compounds of the present invention are included in amounts of 0.5 ppm or greater, preferably, from 1 ppm to 20 ppm, more preferably, from 5 ppm to 20 ppm, even more preferably, from 7 ppm to 20 ppm, further preferably, from 10 ppm to 20 ppm, most preferably, from 15 ppm to 20 ppm.

Sources of copper ions and counter anions include, but are not limited to, water soluble halides, nitrates, acetates, sulfates and other organic and inorganic salts of copper. Mixtures of one or more of such copper salts can be used to provide copper ions. Examples are copper sulfate, such as copper sulfate pentahydrate, copper chloride, copper nitrate, copper hydroxide and copper sulfamate. Preferably, the one or more sources of copper ions in the electroless copper plating composition of the present invention range from 0.5 g/L to 30 g/L, more preferably, from 1 g/L to 25 g/L, even more preferably, from 5 g/L to 20 g/L, further preferably, from 5 g/L to 15 g/L, and most preferably, from 10 g/L to 15 g/L.

Complexing agents include, but are not limited to, sodium potassium tartrate, sodium tartrate, sodium salicylate, sodium salts of ethylenediamine tetraacetic acid (EDTA), nitriloacetic acid and its alkali metal salts, gluconic acid, gluconates, triethanolamine, modified ethylene diamine tetraacetic acids, S,S-ethylene diamine disuccinic acid, hydantoin and hydantoin derivatives. Hydantoin derivatives include, but are not limited to, 1-methylhydantoin, 1,3-dimethylhydantoin and 5,5-dimethylhydantoin. Preferably, the complexing agents are chosen from one or more of sodium potassium tartrate, sodium tartrate, nitriloacetic acid and its alkali metal salts, such as sodium and potassium salts of nitirloacetic acid, hydantoin and hydantoin derivatives. Preferably, EDTA and its salts are excluded from the electroless copper plating compositions of the present invention. More preferably, the complexing agents are chosen from sodium potassium tartrate, sodium tartrate, nitriloacetic acid, nitriloacetic acid sodium salt, and hydantoin derivates. Even more preferably, the complexing agents are chosen from sodium potassium tartrate, sodium tartrate, 1-methylhydantoin, 1,3-dimethylhydantoin and 5,5-dimethylhydantoin. Further preferably, the complexing agents are chosen from sodium potassium tartrate and sodium tartrate. Most preferably, the complexing agent is sodium potassium tartrate.

Complexing agents are included in the electroless copper plating compositions of the present invention in amounts of 10 g/l to 150 g/L, preferably, from 20 g/L to 150 g/L, more preferably, from 30 g/L to 100 g/L, even more preferably, from 35 g/L to 80 g/L, and, most preferably, from 35 g/l to 55 g/L.

Reducing agents include, but are not limited to, formaldehyde, formaldehyde precursors, formaldehyde derivatives, such as paraformaldehyde, aldehydes, borohydrides, such sodium borohydride, substituted borohydrides, boranes, such as dimethylamine borane (DMAB), saccharides, such as grape sugar (glucose), glucose, sorbitol, cellulose, cane sugar, mannitol and gluconolactone, hypophosphite and salts thereof, such as sodium hypophosphite, hydroquinone, catechol, resorcinol, quinol, pyrogallol, hydroxyquinol, phloroglucinol, guaiacol, gallic acid, glyoxylic acid, 3,4-dihydroxybenzoic acid, phenolsulfonic acid, cresolsulfonic acid, hydroquinonsulfonic acid, catecholsulfonic acid, tiron and salts of all of the foregoing reducing agents. Preferably, the reducing agents are chosen from formaldehyde, formaldehyde derivatives, formaldehyde precursors, borohydrides and hypophosphite and salts thereof, hydroquinone, catechol, resorcinol, and gallic acid. More preferably, the reducing agents are chosen from formaldehyde, formaldehyde derivatives, formaldehyde precursors, and sodium hypophosphite. Most preferably, the reducing agent is formaldehyde.

Reducing agents are included in the electroless copper plating compositions of the present invention in amounts of 0.5 g/L to 100 g/L, preferably, from 0.5 g/L to 60 g/L, more preferably, from 1 g/L to 50 g/L, even more preferably, from 1 g/L to 20 g/L, further preferably, from 1 g/L to 10 g/L, most preferably, from 1 g/L to 5 g/L.

A pH of the electroless copper plating composition of the present invention is greater than 7. Preferably, the pH of the electroless copper plating compositions of the present invention is greater than 7.5. More preferably, the pH of the electroless copper plating compositions range from 8 to 14, even more preferably, from 10 to 14, further preferably, from 11 to 13, and most preferably, from 12 to 13.

Optionally, but preferably, one or more pH adjusting agents can be included in the electroless copper plating compositions of the present invention to adjust the pH of the electroless copper plating compositions to an alkaline pH. Acids and bases can be used to adjust the pH, including organic and inorganic acids and bases. Preferably, inorganic acids or inorganic bases, or mixtures thereof are used to adjust the pH of the electroless copper plating compositions of the present invention. Inorganic acids suitable for use of adjusting the pH of the electroless copper plating compositions include, for example, phosphoric acid, nitric acid, sulfuric acid and hydrochloric acid. Inorganic bases suitable for use of adjusting the pH of the electroless copper plating compositions include, for example, ammonium hydroxide, sodium hydroxide, lithium hydroxide and potassium hydroxide. Preferably, sodium hydroxide, potassium hydroxide or mixtures thereof are used to adjust the pH of the electroless copper plating compositions, most preferably, sodium hydroxide is used to adjust the pH of the electroless copper plating compositions of the present invention.

Optionally, but preferably, one or more stabilizers can be included in the electroless copper plating compositions of the present invention. Stabilizers include, but are not limited to 2,2'-dipyridyl, 4,4'-dipyridyl, phenanthroline and phenanthroline derivatives, thiomalic acid, mercaptosuccinic acid, 2,2'dithiodisuccinic acid, cysteine, methionine, thionine, thiourea, benzothiazole, mercaptobenzothiazole, thiosulfate, polypropylene glycol and polyethylene glycol.

Such optional stabilizers are included in the electroless copper plating compositions of the present invention in amounts of 0.1 ppm to 20 ppm, preferably, from 0.5 ppm to 10 ppm, more preferably, from 0.5 ppm to 5 ppm, most preferably from 0.5 ppm to 2 ppm.

Optionally, but preferably, one or more secondary accelerators can be included in the electroless copper plating compositions of the present invention. Such secondary accelerators include, but are not limited to, nitrogen bases such as guanidine, guanidine hydrochloride, pyridine and pyridine derivatives such as aminopyridine, di- and trialkylamines, such as trimethylamine, trimethylamine, and nitrogen compounds such as N,N,N',N'-tetrakis(2-hydroxypropyl)ethylenediamine, and ethylenediaminetetraacetic acid, and metal salts such as nickel(II) salts such as nickel(II) sulfate.

Such secondary accelerators can be included in amounts of 0.1 ppm to 500 ppm, preferably, from 0.2 to 15 ppm, more preferably from, 0.3 ppm to 10 ppm, most preferably from 0.3 ppm to 5 ppm.

Optionally, one or more surfactants can be included in the electroless copper plating compositions of the present invention. Such surfactants include ionic, such as cationic and anionic surfactants, non-ionic and amphoteric surfactants. Mixtures of the surfactants can be used. Surfactants can be included in the compositions in amounts of 0.001 g/L to 50 g/L, preferably in amounts of 0.01 g/L to 50 g/L.

Cationic surfactants include, but are not limited to, tetraalkylammonium halides, alkyltrimethylammonium halides, hydroxyethyl alkyl imidazoline, alkylimidazolium, alkylbenzalkonium halides, alkylamine acetates, alkylamine oleates and alkylaminoethyl glycine.

Anionic surfactants include, but are not limited to, alkylbenzenesulfonates, alkyl or alkoxy naphthalene sulfonates, alkyldiphenyl ether sulfonates, alkyl ether sulfonates, alkylsulfuric esters, polyoxyethylene alkyl ether sulfuric esters, polyoxyethylene alkyl phenol ether sulfuric esters, higher alcohol phosphoric monoesters, polyoxyalkylene alkyl ether phosphoric acids (phosphates) and alkyl sulfosuccinates.

Amphoteric surfactants include, but are not limited to, 2-alkyl-N-carboxymethyl or ethyl-N-hydroxyethyl or methyl imidazolium betaines, 2-alkyl-N-carboxymethyl or ethyl-N-carboxymethyloxyethyl imidazolium betaines, dimethylalkyl betains, N-alkyl-β-aminopropionic acids or salts thereof and fatty acid amidopropyl dimethylaminoacetic acid betaines.

Preferably, the surfactants are non-ionic. Non-ionic surfactants include, but are not limited to, alkyl phenoxy polyethoxyethanols, polyoxyethylene polymers having from 20 to 150 repeating units and random and block copolymers of polyoxyethylene and polyoxypropylene, and polyamines, such as polyallylamines.

Optionally, one or more grain refiner can be included in the electroless copper plating compositions of the present invention. Grain refiners include, but are not limited to, cyanide and cyanide containing inorganic salts such as potassium hexacyanoferrate, 2-mercaptobenthiazole, 2,2'-bipyridine and 2,2'-bipyridine derivatives, 1,10-phenanthroline and 1,10-phenanthroline derivatives, vanadium oxides such as sodium Metavanadate, and nickel salts such as nickel(II) sulfate. Such grain refiners can be included in the electroless copper baths of the present invention in conventional amounts which are well known to those of ordinary skill in the art.

Preferably, the electroless copper plating compositions of the present invention consist of one or more sources of copper ions, including corresponding anions, one or more di-cation viologen compounds having formula (I), one or more complexing agents, one or more reducing agents, water, optionally, one or more pH adjusting agents, optionally, one or more stabilizers, optionally, one or more surfactants, optionally, one or more grain refiners, and, optionally, one or more secondary accelerators, wherein a pH of the electroless copper plating compositions is greater than 7.

More preferably, the electroless copper plating compositions of the present invention consist of one or more sources of copper ions, including corresponding anions, one or more di-cation viologen compounds having formula (I), wherein the anion of formula (I) is a halogen, one or more complexing agents, one or more reducing agents, water, one or more pH adjusting agents, one or more stabilizers, optionally, one or more surfactants, optionally, one or more grain refiners, and, optionally, one or more secondary accelerators, wherein a pH of the electroless copper plating compositions is 10-14.

Most preferably, the electroless copper plating compositions of the present invention consist of one or more sources of copper ions, including corresponding anions, ethyl viologen dibromide or benzyl viologen dichloride or mixtures thereof, one or more complexing agents, one or more reducing agents, water, one or more pH adjusting agents, one or more stabilizers, optionally, one or more surfactants, optionally, one or more grain refiners, and, optionally, one or more secondary accelerators, wherein a pH of the electroless copper plating compositions is 11-13.

The electroless copper compositions and methods of the present invention can be used to electroless plate copper on various substrates such as dielectrics, semiconductors, metal-clad and unclad substrates such as printed circuit boards. Such metal-clad and unclad printed circuit boards can include thermosetting resins, thermoplastic resins and combinations thereof, including fibers, such as fiberglass, impregnated embodiments of the foregoing, and polyimides. Preferably the substrate is a metal-clad printed circuit or wiring board with a plurality of through-holes, vias or combinations thereof, or a polyimide (PI). More preferably, the substrate is a metal-clad printed circuit or wiring board with a plurality of through-holes, or a polyimide (PI). The electroless copper plating compositions and methods of the present invention can be used in both horizontal and vertical processes of manufacturing printed circuit boards, preferably, the electroless copper plating compositions and methods of the present invention are used in horizontal processes.

Thermoplastic resins include, but are not limited to, acetal resins, acrylics, such as methyl acrylate, cellulosic resins, such as ethyl acetate, cellulose propionate, cellulose acetate butyrate and cellulose nitrate, polyethers, nylon, polyethylene, polystyrene, styrene blends, such as acrylonitrile styrene and copolymers and acrylonitrile-butadiene styrene copolymers, polycarbonates, polychlorotrifluoroethylene, and vinylpolymers and copolymers, such as vinyl acetate, vinyl alcohol, vinyl butyral, vinyl chloride, vinyl chloride-acetate copolymer, vinylidene chloride and vinyl formal.

Thermosetting resins include, but are not limited to allyl phthalate, furane, melamine-formaldehyde, phenol-formaldehyde and phenol-furfural copolymers, alone or compounded with butadiene acrylonitrile copolymers or acrylonitrile-butadiene-styrene copolymers, polyacrylic esters, silicones, urea formaldehydes, epoxy resins, allyl resins, glyceryl phthalates, polyesters and polyimides (PI).

The electroless copper plating compositions and methods of the present invention are very suitable for electroless copper plating on substrates which include polyimides. The substrates can be substantially all polyimide or composites of polyimides and other dielectric materials such as epoxies and fillers such as silica or alumina. The electroless copper plating compositions and methods of the present invention inhibit blister formation on polyimide containing substrates to enable smooth and uniform copper deposits. Preferably, electroless copper is plated on polyimides and polyimide composite substrates with the electroless copper plating compositions and methods of the present invention at temperatures of 35° C. or less, more preferably, the polyimides and polyimide composites are electroless plated with copper at temperatures of room temperature to 35° C., even more preferably, from 30° C. to 35° C., and, most preferably, from 30° C. to 34° C. Examples of polyimides which can be electroless copper plated with the electroless copper plating compositions and methods of the present invention include but are not limited to Pyralux® LF-B black polyimide and Pyralux® LF yellow polyimide (both available from E.I. du Pont de Nemours and Company, Wilmington, Del.).

The electroless copper plating compositions and methods of the present invention can be used to electroless copper plate substrates with both low and high $T_g$ resins. Low $T_g$ resins have a $T_g$ below 160° C. and high $T_g$ resins have a $T_g$ of 160° C. and above. Typically, high $T_g$ resins have a $T_g$ of 160° C. to 280° C. or such as from 170° C. to 240° C. High $T_g$ polymer resins include, but are not limited to, polytetrafluoroethylene (PTFE) and polytetrafluoroethylene blends. Such blends include, for example, PTFE with polypheneylene oxides and cyanate esters. Other classes of polymer resins which include resins with a high $T_g$ include, but are not limited to, epoxy resins, such as difunctional and multifunctional epoxy resins, bimaleimide/triazine and epoxy resins (BT epoxy), epoxy/polyphenylene oxide resins, acrylonitrile butadienestyrene, polycarbonates (PC), polyphenylene oxides (PPO), polyphenylene ethers (PPE), polyphenylene sulfides (PPS), polysulfones (PS), polyamides, polyesters such as polyethyleneterephthalate (PET) and polybutyleneterephthalate (PBT), polyetherketones (PEEK), liquid crystal polymers, polyurethanes, polyetherimides, epoxies and composites thereof.

In the method of electroless copper plating with the electroless copper compositions of the present invention, optionally, the substrates are cleaned or degreased, optionally, roughened or micro-roughened, optionally, the substrates are etched or micro-etched, optionally, a solvent swell is applied to the substrates, through-holes are desmeared, and various rinse and anti-tarnish treatments can, optionally, be used. If the substrate is polyimide or includes polyimide, the polyimide is, preferably, treated with an oxygen plasma using conventional plasma apparatus and methods known in the art for treating polyimide.

Preferably, the substrates to be electroless copper plated with the electroless copper plating compositions and methods of the present invention are metal-clad substrates with dielectric material and a plurality of through-holes such as printed circuit boards. Optionally, the boards are rinsed with water and cleaned and degreased followed by desmearing the through-hole walls. Prepping or softening the dielectric or desmearing of the through-holes can begin with application of a solvent swell. Although, it is preferred, that the method of electroless copper plating is for plating through-hole walls, it is envisioned that the method of electroless copper plating can also be used to electroless copper plate walls of vias.

Conventional solvent swells can be used. The specific type can vary depending on the type of dielectric material. Minor experimentation can be done to determine which solvent swell is suitable for a particular dielectric material. The $T_g$ of the dielectric often determines the type of solvent swell to be used. Solvent swells include, but are not limited to, glycol ethers and their associated ether acetates. Conventional amounts of glycol ethers and their associated ether acetates well known to those of skill in the art can be used. Examples of commercially available solvent swells are CIRCUPOSIT™ Conditioner 3302A, CIRCUPOSIT™ Hole Prep 3303 and CIRCUPOSIT™ Hole Prep 4120 solutions (available from Dow Advanced Materials).

After the solvent swell, optionally, a promoter can be applied. Conventional promoters can be used. Such promoters include sulfuric acid, chromic acid, alkaline permanganate or plasma etching. Preferably, alkaline permanganate is used as the promoter. Examples of commercially available promoters are CIRCUPOSIT™ Promoter 4130 and CIRCUPOSIT™ MLB Promoter 3308 solutions (available from Dow Advanced Materials). Optionally, the substrate and through-holes are rinsed with water.

If a promoter is used, a neutralizer is then applied to neutralize any residues left by the promoter. Conventional neutralizers can be used. Preferably, the neutralizer is an aqueous acidic solution containing one or more amines or a solution of 3 wt % hydrogen peroxide and 3 wt % sulfuric acid. An example of a commercially available neutralizer is CIRCUPOSIT™ MLB Neutralizer 216-5. Optionally, the substrate and through-holes are rinsed with water and then dried.

After neutralizing an acid or alkaline conditioner is applied. Conventional conditioners can be used. Such conditioners can include one or more cationic surfactants, non-ionic surfactants, complexing agents and pH adjusters or buffers. Examples of commercially available acid conditioners are CIRCUPOSIT™ Conditioners 3320A and 3327 solutions (available from Dow Advanced Materials). Suitable alkaline conditioners include, but are not limited to, aqueous alkaline surfactant solutions containing one or more quaternary amines and polyamines. Examples of commercially available alkaline surfactants are CIRCUPOSIT™ Conditioner 231, 3325, 813 and 860 formulations (available from Dow Advanced Materials). Optionally, the substrate and through-holes are rinsed with water.

Optionally, conditioning can be followed by micro-etching. Conventional micro-etching compositions can be used. Micro-etching is designed to provide a micro-roughened metal surface on exposed metal (e.g. innerlayers and surface etch) to enhance subsequent adhesion of plated electroless copper and later electroplate. Micro-etches include, but are not limited to, 60 g/L to 120 g/L sodium persulfate or sodium or potassium oxymonopersulfate and sulfuric acid (2%) mixture, or generic sulfuric acid/hydrogen peroxide. Examples of commercially available micro-etching compositions are CIRCUPOSIT™ Microetch 3330 Etch solution and PREPOS1T™ 748 Etch solution (both available from Dow Electronic Materials). If the substrate is a polyimide or includes a polyimide, preferably, the polyimide is conditioned with an aluminum chelating solution, such as CIRCUPOSIT™ Al-Chelate alkaline solution (available from The Dow Electronic Materials). Optionally, the substrate is rinsed with water.

Optionally, a pre-dip can then be applied to the micro-etched substrate and through-holes. Examples of pre-dips include, but are not limited to, organic salts such as sodium potassium tartrate or sodium citrate, 0.5% to 3% sulfuric acid, nitric acid or an acidic solution of 25 g/L to 75 g/L sodium chloride. An example of a commercially available acidic pre-dip is Pre-Dip CIRCUPOSIT™ 6520 acid solution (available from Dow Electronic Materials). A catalyst is then applied to the substrate. While it is envisioned that any conventional catalyst suitable for electroless metal plating which includes a catalytic metal can be used, preferably, a palladium catalyst is used in the methods of the present invention. The catalyst can be a non-ionic palladium catalyst, such as a colloidal palladium-tin catalyst, or the catalyst can be an ionic palladium. If the catalyst is a colloidal palladium-tin catalyst, an acceleration step is done to strip tin from the catalyst and to expose the palladium metal for electroless copper plating. If the catalyst is a colloidal palladium-tin catalyst, an acceleration step is applied after catalyst adsorption, for example, by using hydrochloric acid, sulfuric acid or tetrafluoroboric acid as the accelerator at 0.5-10% in water to strip tin from the catalyst and to expose the palladium metal for electroless copper plating. If the catalyst is an ionic catalyst, the acceleration step is excluded from the method and, instead, a reducing agent is applied to the substrate subsequent to application of the ionic catalyst to reduce the metal ions of the ionic catalyst to their metallic state, such as Pd (II) ions to Pd° metal. Examples of suitable commercially available colloidal palladium-tin catalysts are CIRCUPOSIT™ 3340 catalyst and CATAPOSIT™ 44 catalyst (available from Dow Advanced Materials). An example of a commercially available palladium ionic catalyst is CIRCUPOSIT™ 6530 Catalyst. The catalyst can be applied by immersing the substrate in a solution of the catalyst, or by spraying the catalyst solution on the substrate, or by atomization of the catalyst solution on the substrate using conventional apparatus. The catalysts can be applied at temperatures from room temperature to 80° C., preferably, from 30° C. to 60° C. The substrate and through-holes are optionally rinsed with water after application of the catalyst.

Conventional reducing agents known to reduce metal ions to metal can be used to reduce the metal ions of the catalysts to their metallic state. Such reducing agents include, but are not limited to, dimethylamine borane (DMAB), sodium borohydride, ascorbic acid, iso-ascorbic acid, sodium hypophosphite, hydrazine hydrate, formic acid and formaldehyde. Reducing agents are included in amounts to reduce substantially all of the metal ions to metal. Such amounts are well known by those of skill in the art. If the catalyst is an ionic catalyst, the reducing agents are applied subsequent to the catalyst being applied to the substrate and prior to metallization.

The substrate and walls of the through-holes are then plated with copper using an electroless copper plating composition of the present invention. Methods of electroless copper plating of the present invention can be done at temperatures of 40° C. or less. Preferably, methods of electroless copper plating of the present invention are done at temperatures from room temperature to 40° C., more preferably, electroless copper plating is done from room temperature to 35° C., even more preferably, from 30° C. to 35° C., most preferably, from 30° C. to 34° C. The substrate can be immersed in the electroless copper plating composition of the present invention or the electroless copper plating composition can be sprayed on the substrate. Methods of electroless copper plating of the present invention using electroless copper plating compositions of the present invention are performed in an alkaline environment of pH greater than 7. Preferably, methods of electroless copper plating of the present invention are done at a pH of greater than 7.5, more preferably, electroless copper plating is done at a pH of 8 to 14, even more preferably, from 10 to 14, further preferably, from 11 to 13, and most preferably, from 12 to 13.

Preferably, the electroless copper plating rates of the present invention are equal to or greater than 7.5 μm/hr. at temperatures of less than or equal to 40° C., more preferably, the electroless copper plating rates of the present invention are equal to or greater than 10 μm/hr., most preferably, the electroless copper plating rates are from 12 μm/hr. to 16 μm/hr. at temperatures of less than or equal to 37° C., such as 32° C. to 37° C., or such as 32° C. to 35° C.

The methods of electroless copper plating using the electroless copper plating compositions of the present invention enable good average backlight values (based on European Backlight Grading Scale) for electroless copper plating of through-holes of printed circuit boards. Such average backlight values are preferably greater than or equal to 4.5, more preferably from 4.6 to 5, even more preferably from 4.7 to 5, most preferably from 4.8 to 5.

Such high average backlight values enable the methods of electroless copper plating of the present invention using the electroless copper plating compositions of the present invention to be used for commercial electroless copper plating, wherein the printed circuit board industry substantially requires backlight values of 4.5 and greater. In addition, the electroless copper plating compositions of the present invention are stable over several MTOs, preferably, from 0 MTO to 1 MTO, more preferably, from 0 MTO to 5 MTO, most preferably, from 0 MTO to 8 MTO without requiring bath maintenance such as electroless copper plating bath dilutions or bail-out other than for replenishing compounds spent during electroless plating. The electroless copper metal plating compositions and methods of the present invention enable smooth, uniform, bright copper deposits over broad concentration ranges of di-cation viologen compounds, even at high plating rates.

The following examples are not intended to limit the scope of the invention but to further illustrate the invention.

Example 1

Through-Hole Coverage Over Several MTO with the Aqueous Alkaline Electroless Cooper Composition of the Preset Invention The following aqueous alkaline electroless copper composition of the invention is prepared having the components and amounts disclosed in Table 1 below.

TABLE 1

| COMPONENT | AMOUNT |
|---|---|
| Copper sulfate pentahydrate | 10 g/L |
| Sodium potassium tartrate | 40 g/L |
| Sodium hydroxide | 8 g/L |
| Formaldehyde | 4 g/L |
| 2,2'-dithiodisuccinic acid | 0.5 ppm |
| Ethyl viologen dibromide | 5 ppm |
| Guanidine Hydrochloride | 0.36 ppm |
| Water | To one liter |

The pH of the aqueous alkaline electroless copper compositions have a pH=12.5 at room temperature as measured using a conventional pH meter available from Fisher Scientific.

Six (6) each of six (6) different FR/4 glass epoxy panels with a plurality of through-holes are provided: TUC-662, SY-1141, IT-180, 370HR, EM825 and NPGN. The panels are either four-layer or eight-layer copper-clad panels. TUC-662 is obtained from Taiwan Union Technology, and SY-1141 is obtained from Shengyi. IT-180 is obtained from 1TEQ Corp., NPGN is obtained from NanYa and 370HR from Isola and EM825 are obtained from Elite Materials Corporation. The $T_g$ values of the panels range from 140° C. to 180° C. Each panel is 5 cm×12 cm.

The through-holes of each panel are treated as follows:

1. The through-holes of each panel are desmeared with CIRCUPOSIT™ Hole Prep 3303 solution for 6 min. at 80° C.;
2. The through-holes of each panel are then rinsed with flowing tap water for 2 min.;
3. The through-holes are then treated with CIRCUPOSIT™ MLB Promoter 3308 aqueous permanganate solution at 80° C. for 8 min.;
4. The through-holes are then rinsed for 2 min. in flowing tap water;
5. The through-holes are then treated with CIRCUPOSIT™ MLB neutralizer 216-5 at room temperature for 2 min.;
6. The through-holes of each panel are then rinsed with flowing tap water for 2 min.;
7. The through-holes of each panel are then treated with CIRCUPOSIT™ Conditioner 231 alkaline solution for 1.5 min. at 40° C.;
8. The through-holes are then rinsed with flowing tap water for 2 min.;
9. The through-holes are then treated with a sodium persulfate/sulfuric acid etch solution for 1 min. at 25° C.;
10. The through-holes of each panel are then rinsed with flowing DI water for 2 min.;

11. The panels are then immersed into acidic Pre-Dip CIRCUPOSIT™ 6520 for 0.5 min. and then into CIRCUPOSIT™ 6530 Catalyst which is an ionic aqueous alkaline palladium catalyst concentrate (both available from Dow Electronic Materials) for 1 min. at 40° C., wherein the catalyst is buffered with sufficient amounts of sodium carbonate, sodium hydroxide or nitric acid to achieve a catalyst pH of 9-9.5, then the panels are rinsed with DI water for 1 min. at room temperature;
12. The panels are then immersed into a 0.6 g/L dimethylamine borane and 5 g/L boric acid solution at 30° C. for 1 min. to reduce the palladium ions to palladium metal, then the panels are rinsed with DI water for 2 min.;
13. The panels are then immersed in the electroless copper plating composition of Table 1 and copper is plated at 34° C., at a pH of 12.5 and copper is deposited on the walls of the through-holes for 5 min. with bath aging at 0 MTO, 1 MTO, 2 MTO, 3 MTO, 4 MTO and 8 MTO;
14. The copper plated panels are then rinsed with flowing tap water for 4 min.;
15. Each copper plated panel is then dried with compressed air; and
16. The walls of the through-holes of the panels are examined for copper plating coverage using the backlight process described below.

Each panel is cross-sectioned at or near the centers of the through-holes to expose the copper plated walls. The cross-sections, no more than 3 mm thick from the center of the through-holes, are taken from each panel to determine the through-hole wall coverage. The European Backlight Grading Scale is used. The cross-sections from each panel are placed under a conventional optical microscope of 10× magnification with a light source behind the samples. The quality of the copper deposits are determined by the amount of light visible under the microscope that is transmitted through the sample. Transmitted light is only visible in areas of the plated through-holes where there is incomplete electroless coverage. If no light is transmitted and the section appears completely black, it is rated a 5 on the backlight scale indicating complete copper coverage of the through-hole wall. If light passes through the entire section without any dark areas, this indicates that there is very little to no copper metal deposition on the walls and the section was rated 0. If sections have some dark regions as well as light regions, they are rated between 0 and 5. A minimum of ten through-holes are inspected and rated for each board. Backlight values of 4.5 and greater are indicative of commercially acceptable coverage in the plating industry.

The average backlight value for each type of FR/4 glass epoxy panel obtained at the particular MTO is disclosed in the table below.

TABLE 2

| Panel Type | Backlight Value 0 MTO | Backlight Value 1 MTO | Backlight Value 2 MTO | Backlight Value 3 MTO | Backlight Value 4 MTO | Backlight Value 8 MTO |
|---|---|---|---|---|---|---|
| 370HR | 4.8 | 4.6 | 4.7 | 4.6 | 4.7 | 4.7 |
| EM825 | 4.8 | 4.7 | 4.7 | 4.7 | 4.9 | 4.9 |
| IT-180 | 4.6 | 4.6 | 4.9 | 4.7 | 4.6 | 4.7 |
| NPGN | 4.6 | 4.6 | 4.6 | 4.9 | 4.7 | 4.7 |
| SY-1141 | 4.6 | 4.6 | 4.7 | 4.6 | 4.5 | 4.6 |
| TU-662 | 4.9 | 4.6 | 4.7 | 4.6 | 4.7 | 4.7 |

The average backlight values are at 4.5 and greater with the majority of average values exceeding 4.5 at 0 MTO, 1-4 MTO and 8 MTO. This indicates that the electroless copper plating composition has both good electroless copper through-hole plating and is highly stable in its performance. Furthermore, no copper oxide or copper metal precipitate is observed in the electroless copper bath over the entirety of the experiment. The lack of precipitate is indicative of the stability of the formulation.

Example 2

Electroless Copper Plating Rate of an Electroless Copper Plating Composition Containing Ethyl Viologen Dibromide Vs. An Electroless Copper Plating Composition Containing Secondary Accelerator Guanadine Hydrochloride Three electroless copper plating baths are prepared having the formulations shown in Table 3.

TABLE 3

| COMPONENT | Bath 1 | Bath 2 (comparative) | Bath 3 |
|---|---|---|---|
| Copper sulfate pentahydrate | 10 g/L | 10 g/L | 10 g/L |
| Sodium potassium tartrate | 40 g/L | 40 g/L | 40 g/L |
| Formaldehyde | 4 g/L | 4 g/L | 4 g/L |
| 2,2'-dithiodisuccinic acid | 0.5 ppm | 0.5 ppm | 0.5 ppm |
| Ethyl viologen dibromide | 5 ppm | — | 5 ppm |
| Guanidine hydrochloride | — | 0.36 ppm | 0.36 ppm |
| Sodium hydroxide | Sufficient to change to desired pH | Sufficient to change to desired pH | Sufficient to change to desired pH |
| Water | To one liter | To one liter | To one liter |

Each bath is used to plate copper on NP140 bare epoxy substrates from Nanya (Taiwan) at pH values of 11.5 to 13.8. Electroless copper plating is done at 34° C. for 5 minutes. The plating rate is determined by weighing each substrate using a conventional laboratory analytical balance prior to electroless copper plating and then weighing each substrate subsequent to plating and oven drying. The plated electroless deposit thickness is calculated from the weight difference and considering the surface area of the substrate (25 $cm^2$) and the density of the copper deposit (8.92 $g/cm^3$). The electroless deposit thickness is then divided by the plating time to calculate the plating rate in micrometers per hour. The plating rate for each bath at a given pH is shown in Table 4.

TABLE 4

| pH | Bath 1 Plating Rate (μm/hr.) | Bath 2 (Comparative) Plating Rate (μm/hr.) | Bath 3 Plating Rate (μm/hr.) |
|---|---|---|---|
| 11.5 | 5.7 | 5.4 | 6.4 |
| 11.7 | 9 | 8.2 | 9.8 |
| 12.1 | 9.8 | 9 | 11.4 |
| 12.3 | 11 | 10 | 13.2 |
| 12.6 | 11 | 10.4 | 13.8 |
| 13 | 11.4 | 10.6 | 14.6 |
| 13.4 | 11.6 | 9.6 | 15.6 |
| 13.8 | 9.2 | 8.6 | 12.8 |

Bath 1 which included the ethyl viologen dibromide has good electroless copper plating rates at all pH values and overall higher plating rates than Bath 2 which included the conventional guanidine hydrochloride accelerator. When viologen is combined with guanidine hydrochloride, the plating rate is further enhanced.

Example 3

Plating Rate and Through-Hole Plating Performance of Electroless Copper Plating Compositions Containing Increasing Amounts of Ethyl Viologen Dibromide in Addition to Guanidine Hydrochloride Electroless copper plating baths are prepared as shown in Table 5.

TABLE 5

| COMPONENT | Bath 4 (comparative) | Bath 5 | Bath 6 | Bath 7 | Bath 8 | Bath 9 |
|---|---|---|---|---|---|---|
| Copper sulfate pentahydrate | 10 g/L | 10 g/L | 10 g/L | 10 g/L | 10 g/L | 10 g/L |
| Sodium potassium tartrate | 40 g/L | 40 g/L | 40 g/L | 40 g/L | 40 g/L | 40 g/L |
| Formaldehyde | 4 g/L | 4 g/L | 4 g/L | 4 g/L | 4 g/L | 4 g/L |
| 2,2'-dithiodisuccinic acid | 0.5 ppm | 0.5 ppm | 0.5 ppm | 0.5 ppm | 0.5 ppm | 0.5 ppm |
| Sodium hydroxide | 8 g/L | 8 g/L | 8 g/L | 8 g/L | 8 g/L | 8 g/L |
| Guanidine hydrochloride | 0.36 ppm | 0.36 ppm | 0.36 ppm | 0.36 ppm | 0.36 ppm | 0.36 ppm |
| Ethyl viologen bromide | — | 1 ppm | 2 ppm | 5 ppm | 10 ppm | 20 ppm |
| Water | To one liter | To one liter | To one liter | To one liter | To one liter. | To one liter |

A plurality of six different multi-layer, copper-clad FR/4 glass-epoxy panels with a plurality of through-holes are provided as in Example 1: TUC-662, SY-1141, IT-180, 370HR, EM825 and NPGN. These panels are used to determine the ability of each electroless bath composition to deposit electroless copper of acceptable quality in a variety of different through-hole laminate materials. In addition, the plating rate of each electroless bath formulation is calculated by plating a NP140 (Nanya, Taiwan) bare epoxy panel, as described in Example 2. The through-holes of each panel are treated as follows:

1. The through-holes of each panel are desmeared with CIRCUPOSIT™ Hole Prep 3303 solution for 6 min. at 80° C.;
2. The through-holes of each panel are then rinsed with flowing tap water for 4 min.;
3. The through-holes are then treated with CIRCUPOSIT™ MLB Promoter 3308 aqueous permanganate solution at 80° C. for 8 min.;
4. The through-holes are then rinsed for 2 min. in flowing tap water;
5. The through-holes are then treated with a 3 wt % sulfuric acid/3 wt % hydrogen peroxide neutralizer at room temperature for 2 min.;
6. The through-holes of each panel are then rinsed with flowing tap water for 2 min.;
7. The through-holes of each panel are then treated with CIRCUPOSIT™ Conditioner 3320A alkaline solution for 1.5 min. at 45° C.;
8. The through-holes are then rinsed with flowing tap water for 2 min.;
9. The through-holes are then treated with sodium persulfate/sulfuric acid etch solution for 1 min. at room temperature;
10. The through-holes of each panel are then rinsed with flowing DI water for 1 min.;
11. The panels are then immersed into acidic Pre-Dip CIRCUPOSIT™ 6520 for 0.5 min. and then into CIRCUPOSIT™ 6530 Catalyst which is an ionic aqueous alkaline palladium catalyst concentrate (available from Dow Electronic Materials) for 1 min. at 40° C., wherein the catalyst is buffered with sufficient amounts of sodium carbonate, sodium hydroxide or nitric acid to achieve a catalyst pH of 9-9.5, then the panels are rinsed with DI water for 1 min. at room temperature;
12. The panels are then immersed into a 0.6 g/L dimethylamine borane and 5 g/L boric acid solution at 30° C. for 1 min. to reduce the palladium ions to palladium metal, then the panels are rinsed with DI water for 1 min.;
13. The panels are then immersed in the electroless copper plating compositions of Table 5 and copper is plated at 34° C., at a pH of 12.5 and copper is deposited on the walls of the through-holes for 5 min.;
14. The copper plated panels are then rinsed with flowing tap water for 4 minutes;
15. Each copper plated panel is then dried with compressed air; and
16. The walls of the through-holes of the panels are examined for copper coverage as described in Example 2.

Plating rates for each bath are disclosed in Table 6 and the through-hole performance for each bath is disclosed in Table 7.

TABLE 6

| BATH | Plating Rate (μm/hr.) |
|---|---|
| 4 (comparative) | 8.8 |
| 5 | 11.8 |
| 6 | 12.4 |
| 7 | 13.6 |

TABLE 6-continued

| BATH | Plating Rate (μm/hr.) |
|---|---|
| 8 | 13.8 |
| 9 | 13.6 |

Addition of the ethyl viologen dibromide significantly increases electroless copper plating rate in contrast to the plating bath which included guanidine hydrochloride without ethyl viologen dibromide.

TABLE 7

| Panel Type | Backlight Value Bath 4 (comparative) | Backlight Value Bath 5 | Backlight Value Bath 6 | Backlight Value Bath 7 | Backlight Value Bath 8 | Backlight Value Bath 9 |
|---|---|---|---|---|---|---|
| 370HR | 4.7 | 4.7 | 4.6 | 4.6 | 4.6 | 4.7 |
| EM825 | 4.8 | 4.9 | 4.8 | 4.8 | 4.7 | 4.7 |
| IT-180 | 4.2 | 4.6 | 4.9 | 4.9 | 4.7 | 4.6 |
| NPGN | 4.5 | 4.7 | 4.6 | 4.6 | 4.6 | 4.5 |
| SY-1141 | 4.3 | 4.5 | 4.6 | 4.5 | 4.5 | 4.5 |
| TU-662 | 4.5 | 4.7 | 4.7 | 4.7 | 4.6 | 4.7 |

The backlight values for the plating baths containing ethyl viologen dibromide are just as good if not better overall at the higher ethyl viologen concentration as compared to the backlight values for the bath containing only the conventional accelerator guanidine hydrochloride.

Example 4 (Comparative)

Backlight Performance of Electroless Copper Plating Compositions Containing Guanidine Hydrochloride and Neutral 4,4'-Bipyridyl The comparative electroless copper plating composition includes the following components and amounts:

TABLE 8

| COMPONENT | AMOUNT |
|---|---|
| Copper sulfate pentahydrate | 10 g/L |
| Sodium potassium tartrate | 40 g/L |
| Sodium hydroxide | 8 g/L |
| Formaldehyde | 4 g/L |
| 2,2'-Dithiodisuccinic acid | 0.5 ppm |
| Guanidine hydrochloride | 0.36 ppm |
| 4,4'-Bipyridyl | 5 ppm |
| Water | To one liter |

Six different multi-layer, copper-clad FR/4 glass-epoxy panels with a plurality of through-holes are provided as in Example 1: TUC-662, SY-1141, IT-180, 370HR, EM825 and NPGN. The plating rate of each electroless bath formulation is calculated by plating a NP140 bare epoxy panel as described in Example 2. The through-holes of each panel are treated as described in Example 3 where electroless copper plating is done at 34° C. and the electroless copper plating bath has a pH=12.5.

The electroless copper plating rate is determined to be 6.1 μm/hr. The backlight through-hole wall plating results are in Table 9.

TABLE 9

| Panel Type | Backlight Value (comparative) |
|---|---|
| 370HR | 4.5 |
| EM825 | 3 |
| IT-180 | 4 |
| NPGN | 3.9 |
| SY-1141 | 3.9 |
| TU-662 | 4.5 |

Although panels 370HR and TU-662 show minimal acceptable average backlight values of 4.5, the remainder of the panels have average backlight values below 4.5 which are unacceptable. In contrast, the electroless copper plating baths of the present invention, as shown in Examples 1 and 3 above, have a majority of their average backlight values above 4.5 at high plating rates and at a low temperature. In addition, the plating rate in this example is suppressed by the addition of the neutral 4,4'-bipyridyl, as opposed to the rate acceleration effect afforded by the cationic ethyl viologen bromide.

Example 5

Electroless Copper Rate Acceleration by Benzyl Viologen Dichloride

The following aqueous alkaline electroless copper plating compositions are prepared.

TABLE 10

| COMPONENT | Bath 10 | Bath 11 |
|---|---|---|
| Copper sulfate pentahydrate | 10 g/L | 10 g/L |
| Sodium potassium tartrate | 40 g/L | 40 g/L |
| Sodium hydroxide | 8 g/L | 8 g/L |
| Formaldehyde | 4 g/L | 4 g/L |
| 2,2'-Dithiodisuccinic acid | 0.5 ppm | 0.5 ppm |
| Guanidine hydrochloride | — | 0.36 ppm |

TABLE 10-continued

| COMPONENT | Bath 10 | Bath 11 |
|---|---|---|
| Benzyl viologen dichloride | 5 ppm | 5 ppm |
| Water | To one liter | To one liter |

Six different multi-layer, copper-clad FR/4 glass-epoxy panels with a plurality of through-holes are provided as in Example 1: TUC-662, SY-1141, IT-180, 370HR, EM825 and NPGN. The copper plating rate of each electroless bath formulation is calculated by plating a NP140 bare epoxy panel as described in Example 2. The through-holes of each panel are treated as described in Example 3 where electroless copper plating is done at 34° C. and the electroless copper plating bath has a pH=12.5. The plating rate results are in the table below.

TABLE 11

| Plating Bath | Plating Rate (μm/hr.) |
|---|---|
| Bath 10 | 10.2 |
| Bath 11 | 13.3 |

Benzyl viologen dichloride addition to the electroless copper bath formulation results in significant rate acceleration at a low 34° C. temperature and a solution pH value of 12.5. Furthermore, when the benzyl viologen is combined with guanidine hydrochloride, the plating rate is enhanced further.

The through-hole coverage for Baths 10-11 is shown the table below.

TABLE 12

| Panel Type | Backlight Value Bath 10 | Backlight Value Bath 11 |
|---|---|---|
| 370HR | 4.6 | 4.5 |
| EM825 | 4.7 | 4.0 |
| IT-180 | 4.6 | 3.7 |
| NPGN | 4.5 | 4.4 |
| SY-1141 | 4.5 | 4.4 |
| TU-662 | 4.7 | 4.5 |

Backlight performance was significantly better where the electroless bath included benzyl viologen dibromide and excluded guanidine hydrochloride.

Example 6

Acceleration of Copper Plating Rate by Ethyl Viologen in the Presence of 2,2'-Bipyridyl The following aqueous alkaline electroless copper plating compositions are prepared.

TABLE 13

| COMPONENT | Bath 12 (comparative) | Bath 13 | Bath 14 | Bath 15 | Bath 16 |
|---|---|---|---|---|---|
| Copper sulfate pentahydrate | 10 g/L | 10 g/L | 10 g/L | 10 g/L | 10 g/L |
| Sodium potassium tartrate | 40 g/L | 40 g/L | 40 g/L | 40 g/L | 40 g/L |
| Sodium hydroxide | 8 g/L | 8 g/L | 8 g/L | 8 g/L | 8 g/L |
| Formaldehyde | 4 g/L | 4 g/L | 4 g/L | 4 g/L | 4 g/L |
| 2,2'-Dithiodisuccinic acid | 0.5 ppm | 0.5 ppm | 0.5 ppm | 0.5 ppm | 0.5 ppm |
| Guanidine hydrochloride | 0.36 ppm | 0.36 ppm | 0.36 ppm | 0.36 ppm | 0.36 ppm |
| 2,2'-bipyridyl | 2 ppm | 2 ppm | 2 ppm | 2 ppm | 2 ppm |
| Ethyl viologen dibromide | — | 2 ppm | 5 ppm | 10 ppm | 20 ppm |
| Water | To one liter | To one liter | To one liter | To one liter | To one liter |

Each bath is used to electroless copper plate a bare epoxy laminate of NP140 material and stripped of copper cladding, as described in Example 2. The pH of the baths are 13, the plating time is 5 min. and the plating temperature is 37° C. Electroless copper plating is done for one hour.

After plating, the substrates are removed from the plating baths, rinsed with DI water for 2 min. and the thickness of the copper deposits and plating rates are calculated as described above for Example 2. The plating results are in the table below.

TABLE 14

| Plating Bath | Plating Rate (μm/hr.) |
|---|---|
| Bath 12 (comparative) | 7 |
| Bath 13 | 13.3 |
| Bath 14 | 14 |
| Bath 15 | 13.6 |
| Bath 16 | 13.5 |

The electroless copper plating baths which include the ethyl viologen dibromide show a significant increase in plating rate.

In addition, all of the panels have pink and shiny copper deposits over their surfaces, except for Bath 10 which has patches of shiny and dull deposits over the surface. FIG. 1 is an example of a laminate plated with a bath of the present invention having a pink and shiny copper deposit.

Example 7 (Comparative)

Electroless Copper Plating on Black and Yellow PI with a Conventional Electroless Copper Bath Containing Guanidine Hydrochloride The following conventional electroless copper bath is prepared:

TABLE 15

| COMPONENT | AMOUNT |
|---|---|
| Copper sulfate pentahydrate | 10 g/L |
| Sodium potassium tartrate | 40 g/L |
| Sodium hydroxide | 8 g/L |
| Formaldehyde | 4 g/L |
| 2,2'-dithiosuccinic acid | 0.5 ppm |
| Guanidine hydrochloride | 0.36 ppm |
| Water | To one liter |

The bath is used to electroless copper plate a plurality of black and yellow PI laminates (Pyralux® LF-B black polyimide and Pyralux® LF yellow polyimide). The laminate pieces are all 5 cm by 10 cm in size. Prior to electroless plating the laminates are treated with the following process:

1. The PI laminates are treated with an oxygen plasma with an $O_2$ pressure of 300 mTorr and a power of 370 W for 180 sec.;
2. The PI laminates are desmeared with CIRCUPOSIT™ Hole Prep 3303 solution for 2 min. at 50° C.;
3. The through-holes of each panel are then rinsed with flowing tap water for 2 min.;
4. The PI laminates are then treated with CIRCUPOSIT™ MLB Promoter 3308 aqueous permanganate solution at 60° C. for 3 min.;
5. The PI laminates are then rinsed for 2 min. in flowing tap water;
6. The PI laminates are then treated with a 3 wt % sulfuric acid/3 wt % hydrogen peroxide neutralizer at room temperature for 2 min.;
7. The PI laminates are then rinsed with flowing tap water for 2 min.;
8. The PI laminates are then treated with CIRCUPOSIT™ Al-Chelate alkaline solution for 1.5 min. at 50° C.;
9. The PI laminates are then rinsed with flowing tap water for 2 min.;
10. The PI laminates are then treated with CIRCUPOSIT™ 233 alkaline solution for 1.5 min. at 40° C.;
11. The PI laminates are then rinsed with flowing tap water for 2 min.;
12. The PI laminates are then treated with sodium persulfate/sulfuric acid etch solution for 1 min. at room temperature;
13. The PI laminates are then rinsed with flowing DI water for 1 min.;
14. The PI laminates are then immersed into acidic Pre-Dip CIRCUPOSIT™ 6520 for 0.5 min. and then into CIRCUPOSIT™ 6530 Catalyst which is an ionic aqueous alkaline palladium catalyst concentrate (available from Dow Electronic Materials) for 1 minutes at 40° C., wherein the catalyst is buffered with sufficient amounts of sodium carbonate, sodium hydroxide or nitric acid to achieve a catalyst pH of 9-9.5, then the panels are rinsed with DI water for 1 min. at room temperature;
15. The PI laminates are then immersed into a 0.6 g/L dimethylamine borane and 5 g/L boric acid solution at 30° C. for 1 min. to reduce the palladium ions to palladium metal, then the panels are rinsed with DI water for 1 min.;
16. The PI laminates are then immersed in the electroless copper plating composition of Table 15 and copper is plated at 37° C., at a pH of 13 and copper is deposited on the walls of the through-holes for 2.5 min.;
17. The copper plated PI laminates are then rinsed with flowing tap water for 4 minutes;
18. Each copper plated PI laminates is then dried with compressed air; and
19. The PI laminates are examined for any blisters in the deposit using an optical microscope.

Figure 2A:
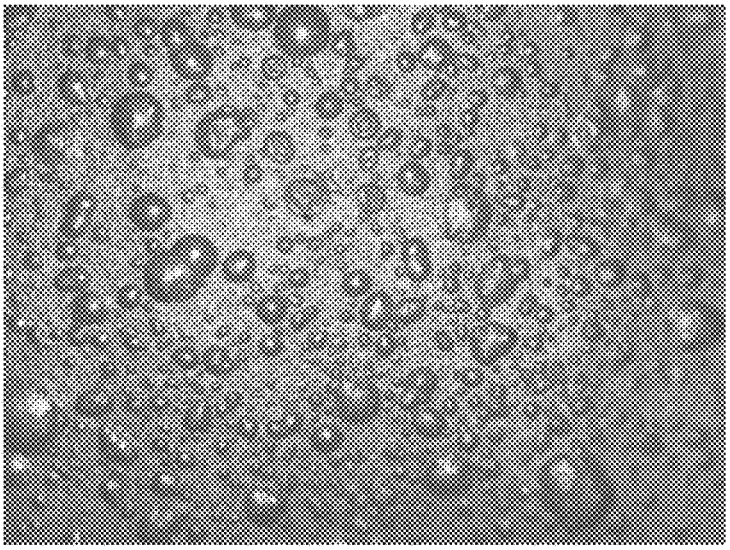
FIGS. 2A and 2B are photographs at 10×, taken with a PX3-CM digital camera from Paxcam attached to an Olympus GX optical microscope, of black polyimide and yellow polyimide films, respectively, plated in an electroless copper baths containing guanidine hydrochloride at a working temperature of 37° C., showing blister formation on the plated deposits.
Figure 2B:
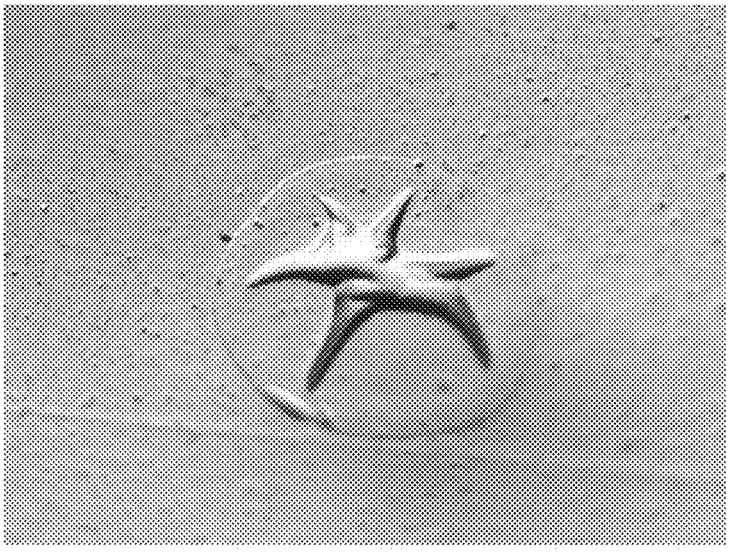

All of the panels show blister formation during plating. FIG. 2A is a photograph of one of the black PI panels showing severe blistering of the surface during plating. FIG. 2B is a photograph of one of the yellow PI panels showing significant blistering. FIG. 2B is dominated by a large collapsed blister in the center of the photograph.

Example 8 (Comparative)

Electroless Copper Plating on Black and Yellow PI with a Conventional Electroless Copper Bath Containing Guanidine Hydrochloride and 2,2'-Dipyridyl The following conventional electroless copper bath is prepared:

TABLE 16

| COMPONENT | AMOUNT |
|---|---|
| Copper sulfate pentahydrate | 10 g/L |
| Sodium potassium tartrate | 40 g/L |
| Sodium hydroxide | 8 g/L |
| Formaldehyde | 4 g/L |
| 2,2'-dithiosuccinic acid | 0.5 ppm |
| Guanidine hydrochloride | 0.36 ppm |
| 2,2'-dipyridyl | 2 ppm |
| Water | To one liter |

The bath is used to electroless copper plate a plurality of black and yellow PI laminates. The laminates have the same dimensions and are prepared for electroless copper plating as in Example 7 above. The pH of the bath is 13 and the plating temperature is 37° C. Electroless copper plating is done for 2.5 min.

Figure 3A:
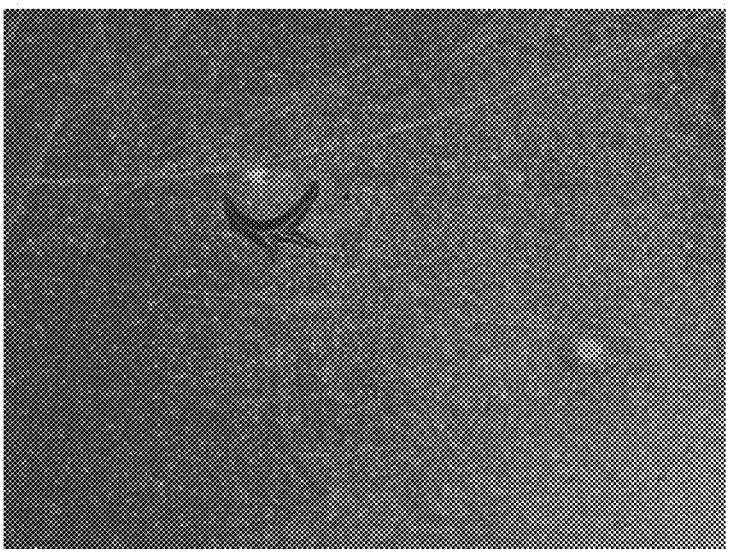
FIGS. 3A and 3B are photographs at 10×, taken with a PX3-CM digital camera from Paxcam attached to an Olympus GX optical microscope, of black polyimide and yellow polyimide films, respectively, showing blisters which formed during plating with comparative electroless copper baths containing guanidine hydrochloride and 2,2'-dipyridyl at 37° C.
Figure 3B:
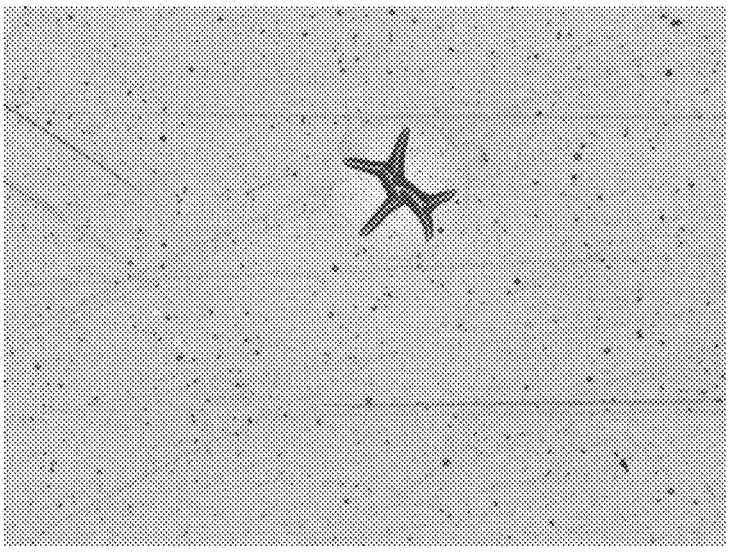

All of the laminates show significant blister formation during plating. FIG. 3A is a photograph of one of the black PI laminates showing blisters. A collapsed blister is dominant near the center of the photograph. FIG. 3B is a photograph of one of the yellow PI laminates also showing blisters. A large collapsed blister is also observable near the center of the photograph.

Example 9

Electroless Copper Plating on Black and Yellow PI with Electroless Copper Baths of the Present Invention Containing Ethyl Viologen Dibromide and 2,2'-Dipyridyl Baths 13, 14 and 15 of Table 13, Example 6 above are used to electroless copper plate a plurality of black and yellow PI laminates. The laminates have the same dimensions and are prepared for electroless copper plating as in Example 7 above. The pH of the baths are 12.5 and the plating temperature is 32° C. Electroless copper plating is performed for 2.5 min. The plating rates of Baths 13, 14 and 15 are 7.2 μm/hr., 8 μm/hr. and 7.9 μm/hr., respectively.

Figure 4A:
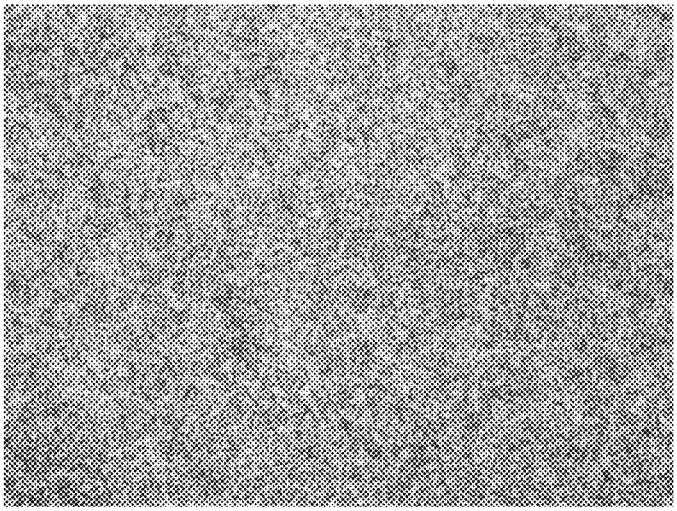
FIGS. 4A and 4B are photographs at 10×, taken with a PX3-CM digital camera from Paxcam attached to an Olympus GX optical microscope, of black polyimide and yellow polyimide films, respectively, free of blisters after having been plated at 32° C. with electroless copper baths of the present invention containing 2 ppm of ethyl viologen dibromide.
Figure 4B:
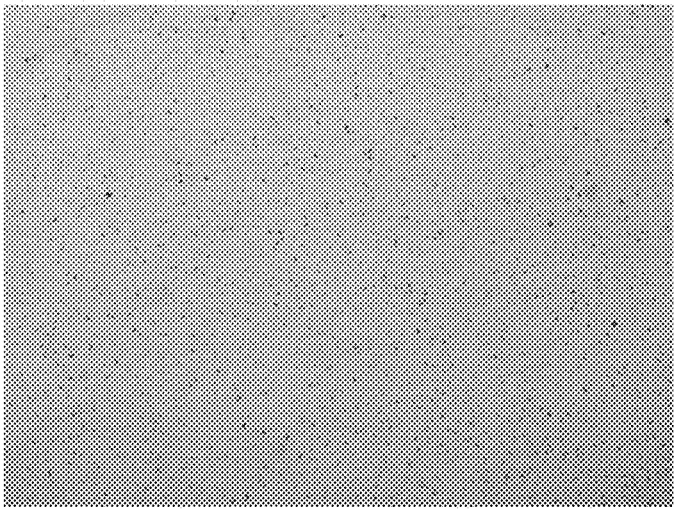
Figure 5A:
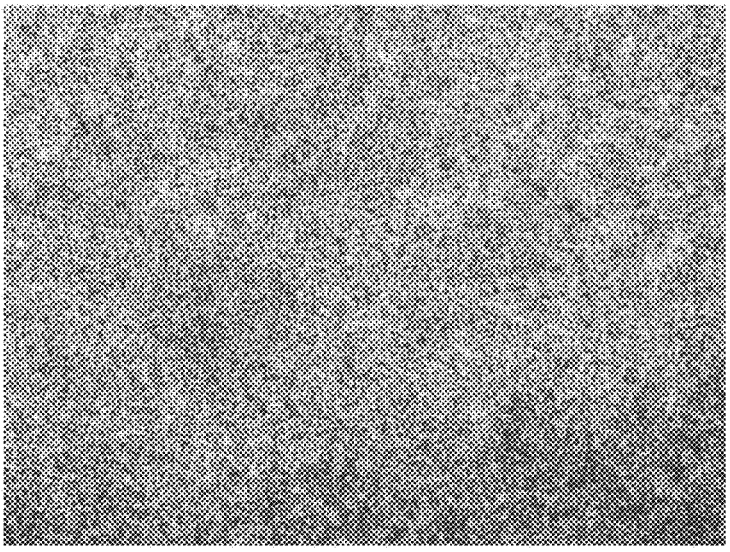
FIGS. 5A and 5B are photographs at 10×, taken with a PX3-CM digital camera from Paxcam attached to an Olympus GX optical microscope, of black polyimide and yellow polyimide films, respectively, free of blisters after having been plated at 32° C. with electroless copper baths of the present invention containing 5 ppm of ethyl viologen dibromide.
Figure 5B:
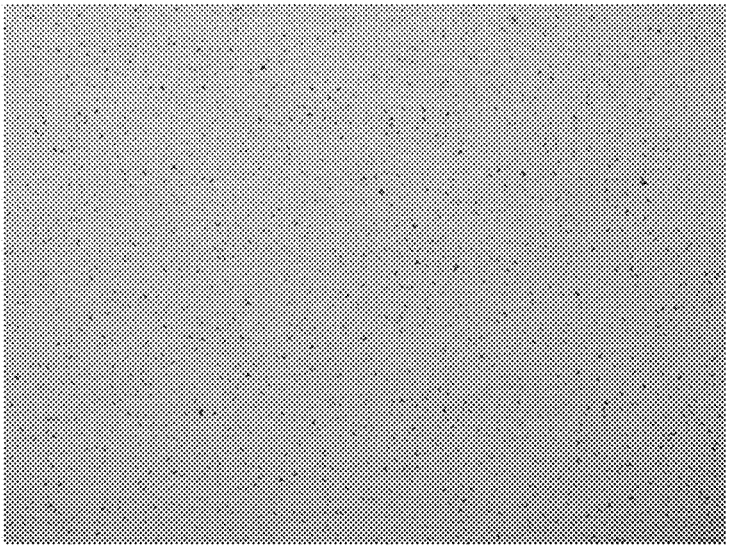
Figure 6A:
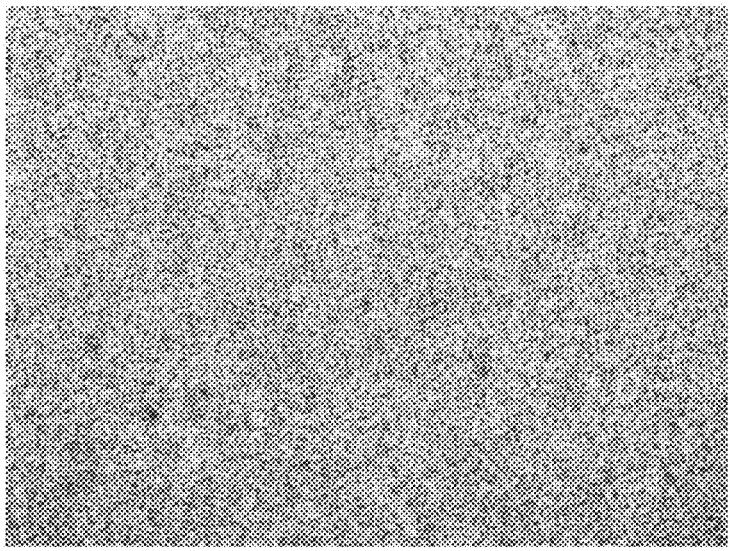
FIGS. 6A and 6B are photographs at 500×, taken with a PX3-CM digital camera from Paxcam attached to an Olympus GX optical microscope, of black polyimide and yellow polyimide films, respectively, free of blisters after having been plated at 32° C. with electroless copper baths of the present invention containing 10 ppm of ethyl viologen dibromide.
Figure 6B:
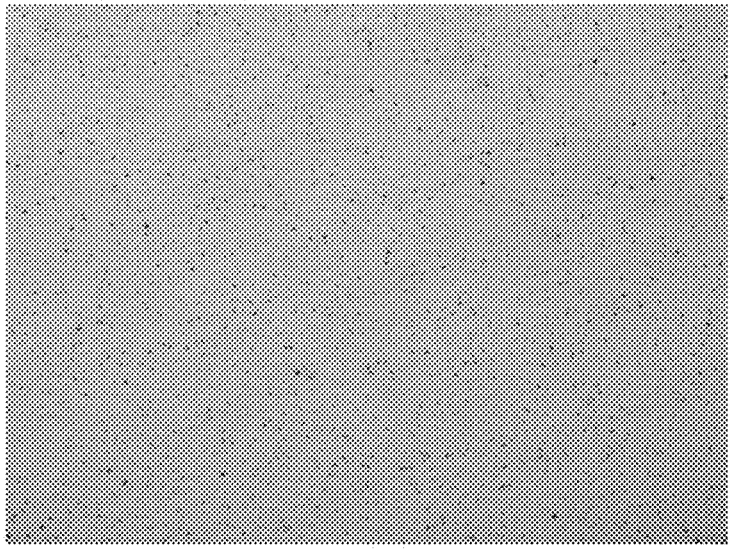

None of the PI laminates show blisters during electroless plating. FIGS. 4A and 4B are black and yellow PI, respectively, being plated with Bath 13, FIGS. 5A and 5B are black and yellow PI, respectively, being plated with Bath 14, and FIGS. 6A and 6B are black and yellow PI, respectively, being plated with Bath 15. None of the Figures show any observable blister formation.

After plating, the laminates are rinsed with DI water at room temperature for 2 min. and air dried. The surface of the copper plated laminates are then observed for surface morphology. The copper deposits are pink, smooth and uniform in appearance.

What is claimed is:

1. An electroless copper plating composition comprising one or more sources of copper ions, one or more di-cation viologen compounds having a formula:

(I)

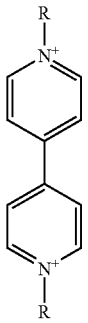

[anion(s)], wherein R is selected from the group consisting of linear or branched ($C_1$-$C_{10}$)alkyl, linear or branched hydroxy($C_1$-$C_{10}$)alkyl, linear or branched alkoxy($C_1$-$C_{10}$)alkyl, linear or branched carboxy($C_1$-$C_{10}$)alkyl, benzyl, amino and cyano, a counter anion(s) to neutralize the one or more di-cation viologen compounds, one or more complexing agents, one or more reducing agents, and, optionally, one or more pH adjusting agents, wherein a pH of the electroless copper plating composition is greater than 7.

2. The electroless copper plating composition of claim 1, wherein the one or more viologen compounds are in amounts of at least 0.5 ppm.

3. The electroless copper plating composition of claim 1, wherein the one or more complexing agents are chosen from sodium potassium tartrate, sodium tartrate, sodium salicylate, sodium salts of ethylenediamine tetraacetic acid, nitriloacetic acid and its alkali metal salts, gluconic acid, gluconates, triethanolamine, modified ethylene diamine tetraacetic acids, s,s-ethylene diamine disuccinic acid, hydantoin and hydantoin derivatives.

4. The electroless copper plating composition of claim 1, wherein the one or more reducing agents are chosen from formaldehyde, formaldehyde precursors, formaldehyde derivatives, borohydrides, substituted borohydrides, boranes, saccharides, and hypophosphite.

5. The electroless copper plating composition of claim 1, further comprising one or more compounds chosen from surfactants, grain refiners, accelerators and stabilizers.

6. A method of electroless copper plating comprising:

a) providing a substrate comprising a dielectric;

b) applying a catalyst to the substrate comprising the dielectric;

c) applying an electroless copper plating composition to the substrate comprising the dielectric, wherein the electroless copper plating composition comprises one or more sources of copper ions, one or more di-cation viologen compounds having a formula:

(I)

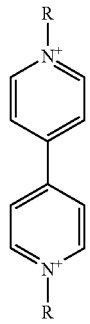

[anion(s)], wherein R is selected from the group consisting of linear or branched ($C_1$-$C_{10}$)alkyl, linear or branched hydroxy ($C_1$-$C_{10}$)alkyl, linear or branched alkoxy($C_1$-$C_{10}$)alkyl, linear or branched carboxy($C_1$-$C_{10}$)alkyl, benzyl, amino and cyano, a counter anion(s) to neutralize the one or more di-cation viologen compounds, one or more complexing agents, one or more reducing agents, and, optionally, one or more pH adjusting agents, wherein a pH of the electroless copper plating composition is greater than 7; and d) electroless plating copper on the substrate comprising the dielectric with the electroless copper plating composition.

7. The method of claim 6, wherein the one or more di-cation viologen compounds are in amounts of at least 0.5 ppm.

8. The method of claim 6, wherein the electroless copper plating composition further comprises one or more compounds chosen from surfactants, grain refiners, stabilizers and accelerators.

9. The method of claim 6, wherein the electroless copper plating composition is at 40° C. or less.

10. The method of claim 6, wherein the catalyst is a palladium catalyst.

* * * * *